United States Patent [19]

Campana et al.

[11] Patent Number: 4,858,673

[45] Date of Patent: Aug. 22, 1989

[54] RISER CONSTRUCTION

[75] Inventors: Patsie C. Campana; David L. Campana, both of Lorain, Ohio

[73] Assignee: Caldo Internationa, Inc., Lorain, Ohio

[21] Appl. No.: 232,936

[22] Filed: Aug. 16, 1988

Related U.S. Application Data

[63] Continuation-in-part of Ser. No. 112,383, Oct. 22, 1987.

[51] Int. Cl.[4] ..... B22C 9/08

[52] U.S. Cl. ..... 164/359; 164/360

[58] Field of Search ..... 164/53, 359, 360

[56] References Cited

FOREIGN PATENT DOCUMENTS 67350 7/1893 Fed. Rep. of Germany .
2822594 11/1979 Fed. Rep. of Germany ..... 164/360
33800 11/1964 German Democratic Rep. .
44-20726 9/1969 Japan ..... 164/360
47-9908 3/1972 Japan ..... 164/360
885436 12/1961 United Kingdom ..... 164/53

*Primary Examiner*—Kuang Y. Lin
*Attorney, Agent, or Firm*—Fay, Sharpe, Beall, Fagan, Minnich & McKee

[57] ABSTRACT

A riser for a mold includes a riser body formed of an exothermic material. A cavity is located in the riser body and is adapted to contain an associated molten metal. An opening is provided in the riser body for communicating the riser body cavity with a cavity of an associated mold. The riser body exothermic material consists essentially of a reactive mixture which includes, in weight percent, from about 25% to 65% silica, from about 5% to 18% sodium nitrate, from about 1% to 8% sodium hexafluorosilicate, from about 15% to 40% aluminum, and from about 2% to 20% iron oxide.

13 Claims, 1 Drawing Sheet

RISER CONSTRUCTION

This application is a continuation-in-part of U.S. patent application Ser. No. 112,383 filed on Oct. 22, 1987 and still pending.

BACKGROUND OF THE INVENTION

The present invention relates to the casting of metal parts and the like. More specifically, the invention relates to an exothermic formed body constructed for use as a riser in an upper portion of a mold.

The invention is specifically applicable to a segmented riser having a spherical internal cavity. The riser is formed from a material having specific exothermic properties. However, it will be recognized that the exothermic material which is described herein can be used for purposes other than in a riser for ingot molding.

After refining operations are completed in the process of manufacturing various metals, such as steel, the molten metal is teemed into a mold where the metal is allowed to solidify into desired cast bodies or ingots. As the metal cools in the mold, imperfections are created in the metal due to the shrinkage thereof during cooling. Such imperfections are caused by the metal in the body or ingot cooling from its exterior periphery inwardly in a gradual manner. During cooling and solidification of the casting, a thin skin of frozen metal forms around the outer part of the mold cavity. This skin forms a rigid shell which acts as a mold for the remainder of the casting. One common imperfection is a funnel shaped contraction in the head of the ingot known as "pipe." Another common imperfection is gas bubbles entrapped in the metal during the cooling process. Other imperfections encountered in the cooling of cast metal include center segregation and porosity, sometimes called "fish tails." All of these reduce the strength of the metal.

The formation of such imperfections due to metal shrinkage in cast metal bodies has been found to be preventable by the application of a riser or hot top which retains and feeds molten metal to the shrinking ingot before and during solidification. A hot top can consist of clay molds, ceramic sleeves within refractory casings or, more commonly, a metal casing with an interior layer of an insulating material bonded to the casing. The hot top is meant to absorb heat from the molten metal less rapidly than the walls of the mold due to the use of insulating material for the hot top walls. Thereby an overlying pool of molten steel is meant to be furnished which feeds metal down into the ingot to overcome the shrinkage problems due to solidification of the metal in the ingot. When risers are small, they cool fast and therefore an exothermic material is sometimes used instead of insulating material on one or more walls of the riser to prolong the time during which the metal remains molten by heating the metal contained in the riser.

One problem with conventional hot tops or risers is that they are generally square in cross section and, therefore, do not minimize the heat loss of the molten metal in the riser structure by reducing the surface area of the molten metal which is exposed to the riser structure.

Another problem with conventional riser assemblies or hot tops is that even when exothermic materials are used, the exothermic properties of the riser structure material are not suitable for prolonging the time during which the metal remains molten so as to adequately fulfill the requirements of the steel molding process.

Even those riser constructions which have a suitable conformation, preferably a spherical conformation, for minimizing the heat loss of molten metal by reducing the surface area of the metal exposed to the riser structure, are not made of a suitable exothermic material which would prolong the heat available to the riser in order to keep the metal therein in a molten state for a sufficient length of time while the rest of the mold cools.

Additionally, when the conventional exothermic material has burned, the resulting clinker does not act as a suitable insulation layer to keep heat in the molten metal held in the riser cavity.

Accordingly, it has been considered desirable to develop a new and improved riser assembly which would overcome the foregoing difficulties and others while providing better and more advantageous overall results.

BRIEF SUMMARY OF THE INVENTION

In accordance with the present invention, a new and improved riser is provided for molds.

More particularly in accordance with this aspect of the invention, the riser includes a riser body formed of an exothermic material. A cavity is located in the riser body and adapted to contain an associated molten metal. An opening is provided in the riser body for communicating the riser body cavity with a cavity of an associated mold. The riser body exothermic material consists essentially of a reactive mixture which includes, in weight percent, from about 25% to 65% silica, from about 5% to 18% sodium nitrate, from about 1% to 8% sodium hexafluorosilicate, from about 15% to 40% aluminum, and from about 2% to 20% iron oxide.

In accordance with another aspect of the invention, the riser body cavity is substantially spherical.

In accordance with still another aspect of the invention, the riser body is formed from two mating sections.

In accordance with yet another aspect of the invention, the riser further has a second opening communicating with the riser body cavity. The second opening is located substantially opposite the first opening.

According to yet still another aspect of the invention, the riser further comprises a binder substance for holding the exothermic material of the riser body in a preformed shape. Preferably, the binder substance consists essentially of sodium silicate.

According to still yet another aspect of the invention, the exterior periphery of the riser body includes a polygonally shaped upper section and a substantially square lower section. Alternatively, the exterior periphery of the riser body is substantially octagonal in shape.

According to a further aspect of the invention, a riser for molds is provided.

More particularly in accordance with this aspect of the invention, the riser comprises a riser body having a cavity which is adapted to contain an associated molten metal. A means is provided for heating the associated molten metal in the body cavity for a period of time. A means for subsequently insulating the associated molten metal in the body cavity is provided after the means for heating has performed its function. The means for heating and the means for insulating are integral with the riser body.

In accordance with a further aspect of the invention, a method is provided for fabricating a riser body.

More particularly in accordance with this aspect of the invention, the method comprises providing an exothermic reactive mixture and an aqueous sodium silicate binder and mixing together the reactive mixture and the binder to form a composition. The composition is shaped into a desired body configuration which is then exposed to a gas in order to set the binder. Thereafter, the body is heated for a length of time to harden the composition in the desired body configuration.

In accordance with a still further aspect of the invention, a method is provided for employing a riser in a molding process. The method comprises providing a mold having a mold cavity therein and a riser body having a cavity therein which is adapted to communicate with the mold cavity. The riser body is made from an exothermic material. A molten metal is flowed into the riser body cavity and the exothermic material of the riser body is combusted to heat the molten metal held in said riser body cavity. After the step of combusting, an insulating material is produced from the riser body exothermic material. The molten metal in the riser body cavity is then insulated to hold the heat in the molten metal.

One advantage of the present invention is the provision of a new and improved riser body which can be used advantageously in metal molding or the like.

Another advantage of the invention is the provision of a new riser body which has a cavity that is substantially spherical in shape.

A further advantage of the invention is the provision of a riser body which is made of a suitable exothermic material that provides heat for a sufficient length of time to keep metal contained in the riser in a molten state as the molded body cools in order to enable the riser structure to feed molten metal to the mold.

A still further advantage of the invention is the provision of a riser body comprising an exothermic material which, after combustion, has insulating properties in order to retain the heat in the molten metal held in the riser body.

A yet further advantage of the invention is the provision of a segmented riser body construction.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
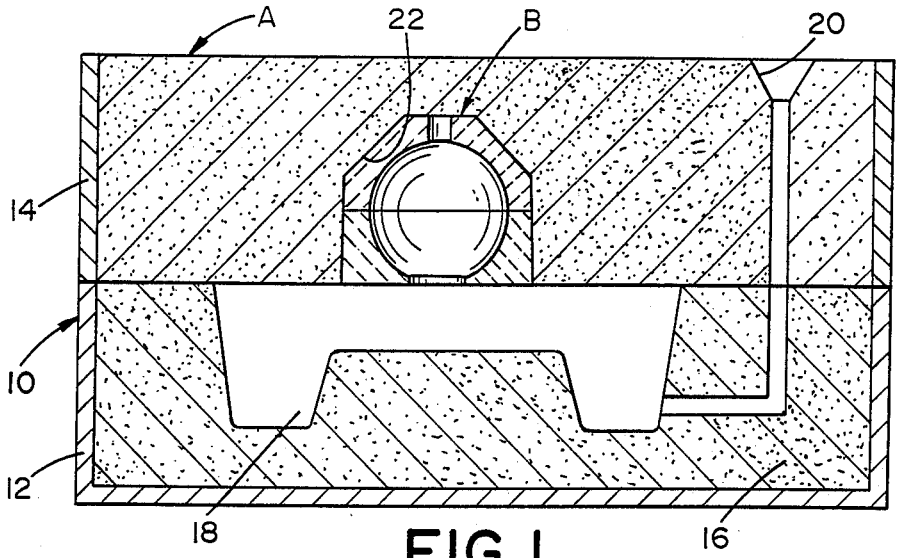
FIG. 1 is a cross sectional view through a mold illustrating the use of a riser structure according to a first preferred embodiment of the present invention in the ingot mold.

Referring now to the drawings wherein the showings are for purposes of illustrating preferred embodiments of the invention only and not for purposes of limiting same, FIG. 1 shows a mold A which contains the subject new riser assembly B. While the riser assembly is primarily designed for and will hereinafter be described in connection with a particular type of ingot mold, it will be appreciated that the overall inventive concept involved could be adapted for use in other metal molding environments in which an exothermic riser can be used. Moreover, it should be recognized that the exothermic material disclosed herein could also be used for many applications outside the field of metal molding.

FIG. 1 illustrates that the mold A can be an ingot mold which has a frame member 10 including two sections 12, 14. The frame 10 is filled with sand 16 in such a way as to form a matrix 18 for receiving molten metal which is to be poured into the ingot mold and for forming the molten metal into a desired shape. A sprue 20 is provided for communicating the molten metal into the ingot mold matrix 18. A riser cavity 22 is provided on a top surface of the matrix 18 in order to hold the riser assembly B which, in turn, holds additional molten metal that will be used to supplement the shrinkage incurred during the cooling and solidification of the metal in the ingot mold.

Figure 2:
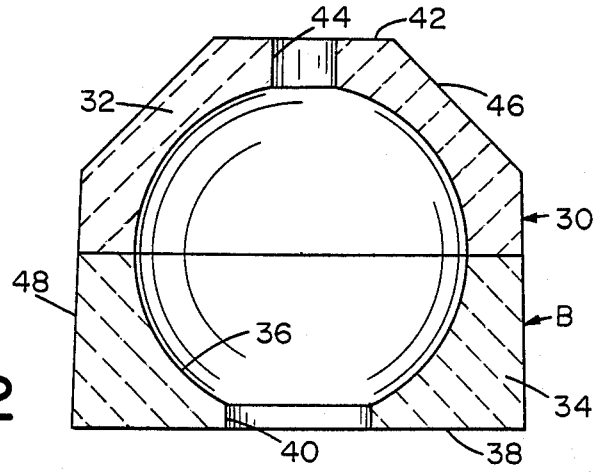
FIG. 2 is an enlarged cross sectional view through the riser structure of FIG. 1; and, FIG. 3 is a cross sectional view through a second preferred embodiment of a riser structure according to the present invention.

With reference now also to FIG. 2, the riser B includes the riser body 30 comprising a first section 32 and a second section 34. It is considered advantageous to provide a segmented riser body because it is easier to manufacture the riser body in this fashion.

A cavity 36 is provided within the riser body 30. Preferably, the cavity is of a substantially spherical shape. Such a shape has been found advantageous in minimizing the heat loss of the molten metal received within the riser body. That is, by reducing the surface area of the molten metal exposed to the mold structure, the metal will maintain its molten or liquid properties for a longer period of time than if the configuration were other than spherical. It is well known that a spherical configuration has a minimal surface area while holding a maximum amount of material as compared with other geometric shapes.

Provided in a bottom surface 38 of the riser is a first aperture 40 for communicating the riser body cavity 36 with the matrix 18. Provided in a top face 42 of the riser body is a second aperture 44 which communicates with the riser body cavity 36. The second aperture 44 enables off-gassing out of the combusting riser body, and the molten metal held in the matrix 18, so that gas bubbles do not become trapped in the cooling metal body contained in the matrix.

In the first preferred embodiment illustrated in FIG. 2, the upper section 32 of the riser body can have a polygonal shape in cross-section whereas a lower section can have a substantially rectangular shape in cross-section. An upper section outer periphery 46 can be polygonal in shape or conically shaped as desired. Similarly, a lower section outer periphery 48 can be square in shape or cylindrically shaped as desired.

As is evident from FIG. 2, more exothermic material is provided in the second or lower section 34 so that additional heat can be transmitted to the molten metal in the lower section of the rise body as the exothermic material burns and gives off heat. As the ingot mold cools and the level of the molten metal within the riser body decreases, the molten metal in the riser lower section will thus be kept in a molten state for a longer period of time since more heat will be delivered to it as the exothermic material is combusted.

Another feature of the riser assembly relates to the exothermic properties of the riser body material. The entire riser body is formed from an exothermic material so that the entire structure surrounding the molten metal held in the riser body cavity 36 assists in maintaining the metal in a molten state.

The exothermic material of the riser body is fabricated from a special mixture of materials which include, in weight percent, from about 25% to 65% silica, from about 5% to 18% sodium nitrate, from about 1% to 8% sodium hexafluorosilicate or cryolite, from about 15% to 40% aluminum, and from about 2% to 20% iron oxide.

The ignition element is produced from a thermite type of material ($Al+Fe_2O_3 \rightarrow Al_2O_3+2Fe$) to which have been added various other materials for the purpose of controlling the rate of the thermite reaction. In this regard, the above described formulation results in a riser body which is exceptionally well suited for the practice of the present invention. In proper circumstances, it may be possible to control the rate of the thermite reaction by using materials other than those specified above. For example, various clays may be substituted for the silica. Other materials of a non-carbonaceous nature can also be used. Carbon, however, should be avoided since carbonaceous materials would result in an unwanted deposition of carbon in the molten metal.

The particle sizes of the various components of the riser body are selected so that upon ignition, the body burns at a relatively slow rate, generally at a rate of about 1 inch per 40 seconds. In the practice of the present invention, a burning rate from about 5 to 60 seconds per inch is desirable with excellent results being achieved when the burning rate ranges from about 30 to 50 seconds per inch. Such burning takes place outwardly from the walls of the riser cavity and can begin when the molten metal first contacts the riser body due to the intense heat of the molten metal.

The particle size of the silica is such that at least 99% passes through a 20 mesh Tyler screen. In practice, the silica component is made up of two different mixes of silica particles. For example, a typical silica formulation comprises 90% Type A silica (as defined below) and 10% Type B silica (as defined below).

Type A Silica

About 0.8–1.0% retained on a 20 mesh screen
About 27.0% retained on a 30 mesh screen
About 62.0% retained on a 40 mesh screen
About 10.0% retained on a 50 mesh screen
About 0.2% retained on a 70 mesh screen
About a trace retained on a 100 mesh screen
About a trace retained on a 140 mesh screen Type B Silica About 0.3% retained on a 20 mesh screen
About 5.8% retained on a 30 mesh screen
About 21.4% retained on a 40 mesh screen
About 44.8% retained on a 50 mesh screen
About 21.5% retained on a 70 mesh screen
About 3.8% retained on a 100 mesh screen
About 1.6% retained on a 140 mesh screen
About 0.8% retained on a 200 mesh screen Both the sodium nitrate and the sodium hexafluorosilicate are preferably sized such that they essentially all pass through an 80 mesh screen.

The iron powder is usually sized such that it passes through a 100 mesh screen.

The aluminum powder is preferably sized such that it has a particle size ranging from about 0.01 to about 4.0 mm.

The various components of the ignition element are mixed together and formed into the desired shape using a suitable binder. A typical binder is aqueous sodium silicate. However, other non-carbonaceous binders could also be used as desired.

The individual components which make up the riser body are mixed together with the sodium silicate binder and formed into the desired configuration illustrated in FIG. 2 by conventional means. Generally, this is done by mixing the reactive mixture components of the riser body with an aqueous sodium silicate binder substance. This mix is then exposed to carbon dioxide to set the silicate. Thereafter, the material is heated in an oven for approximately two hours at approximately 350° to 375° F. to harden the material into the desired riser shape illustrated in FIG. 2.

The ignition temperature of the riser body is in the range of about 1500° F. to about 2000° F. The preferred temperature is about 1750° F. Upon ignition, which is caused either by contacting the riser body with molten metal or by direct ignition from an exterior source, the riser body produces a temperature of about 2750° F. and higher.

Various sizes of riser bodies can be contemplated for differing mold sizes. For example, risers having a cavity radius ranging from one inch to three inches or more can be employed. A one inch cavity radius would provide a volume of approximately 4.188 cubic inches of feed metal. At a density of 0.25 cubic inches per pound, this would provide approximately one pound of feed metal. A three inch radius riser body cavity would provide a volume of approximately 113.1 cubic inches of feed metal. This translates into approximately 28.25 pounds of feed metal at a density of 0.25 $in^3/lb$.

In one embodiment, the riser body has a 2½ inch radius and hence a spherical cavity having a 5 inch diameter is provided. The side walls of the body are 1 inch thick. The base of the body is approximately 7 inches wide and the body is 5⅞ inches high. In this embodiment, a lower opening of 2½ inches is provided along with an upper opening of ¾ inch. In another embodiment, the riser body has a 3 1/16 inch radius. Accordingly, a spherical cavity having a 6⅛ inch diameter is provided. In this embodiment, the side walls of the body are 1¼ inches thick. The base of the body is 8½inches wide and the body is 6⅞inches high. A lower opening of 3 and 1/32 inches is provided together with an upper opening of ¾ inch in the riser body.

It is advantageous to provide a riser body B with a lower opening 40 which has a diameter substantially one half the size of the cavity diameter. Such a ratio of sizes is believed to be beneficial in order to allow the metal held in the riser body cavity 36 to flow into the matrix 18 at the optimum rate as and after it is heated by the riser body.

After the riser body has completed the burning process, it continues to retain its physical integrity. The riser body walls assume, after burning, an insulating function due to the specific chemical composition of the riser body. That is, the burned exothermic material clinker or residue has excellent insulating or heat reflecting properties and helps to keep the heat of the molten metal held in the riser body from being conducted away thereby keeping the metal molten for a longer period of time. More specifically, the true thermal conductivity -k- of the clinker material is very low, in the range of insulating materials of various sorts, so that the material has a high resistance to heat transmission. This enables the riser body to continue feeding molten metal to the ingot for an extended period of time.

Figure 3:
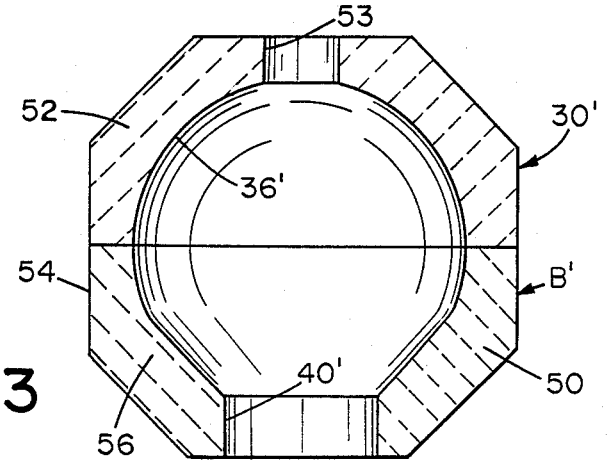

FIG. 3 shows a second preferred embodiment of a riser body according to the present invention. For ease of illustration and appreciation of this modified construction, like components are identified by like numerals with a primed suffix (') and a new components are identified by new numerals.

More particularly, FIG. 3 illustrates a riser B' which includes a body 30' made of first and second conical sections 50, 52. A cavity 36', which can be of substantially spherical shape, is enclosed by the sections 50, 52. The cavity 36' communicates through a lower opening 40' with a matrix. An upper opening 53 communicates with the cavity 36' to allow off-gassing to occur. However, the upper opening or aperture 53 is of somewhat larger diameter than the upper aperture of the first preferred embodiment. A larger diameter aperture can be useful in more readily venting the gases produced during outgassing, both by the cooling metal and by the exothermic material, away from the mold. The first section 50 is quite similar in overall appearance to the upper or first section 32 of the first preferred embodiment.

The second or lower section, however, has been reconfigured to reduce the amount of exothermic material provided. In this connection, the second section has a periphery 54 which, like the first section, has a substantially conical shape. The cross-sectional view of this FIGURE discloses that the second section 52 also includes a thickened portion 56 which enables additional heat to be delivered by the riser body to the metal held in the cavity 36'. It can also be seen that the thickening of the second section 52 leads to a longer opening 40' and a somewhat pear-shaped cross-section for the portion of the cavity 36' adjacent the opening 40'.

The invention has been described with reference to preferred embodiments. Obviously, modifications and alterations will occur to others upon the reading and understanding of this specification. It is intended to include all such modifications and alterations insofar as they come within the scope of the appended claims or the equivalents thereof.

Having thus described preferred embodiments, the invention is now claimed to be:

1. A riser for molds, comprising:

a riser body formed of an exothermic material which is capable of igniting when contacted with molten metal;

a cavity located in said riser body and adapted to contain an associated molten metal;

a first opening in said riser body for communicating said riser body cavity with an associated mold; and, wherein said riser body exothermic material consists essentially of a reactive mixture which includes in weight percent from about 25% to 65% silica, from about 5% to 18% sodium nitrate, from about 1% to 8% sodium hexafluorosilicate, from about 15% to 40% aluminum, and from about 2% to 20% iron oxide.

2. The riser of claim 1 wherein said riser body cavity is substantially spherical.

3. The riser of claim 1 wherein said riser body is formed of two mating sections.

4. The riser of claim 1 further comprising a second opening in said riser body, communicating with said riser body cavity, said second opening being located substantially opposite said first opening.

5. The riser of claim further comprising a binder substance for holding said exothermic material of said riser body in a preformed shape.

6. The riser of claim 5 wherein said binder substance consists essentially of sodium silicate.

7. The riser of claim 1 wherein said riser body, in cross-sectional view, includes a polygonally shaped upper section and a substantially rectangular lower section.

8. The riser of claim wherein an exterior periphery of said riser body includes two substantially conically shaped sections.

9. The riser of claim 1 wherein a diameter of said riser body first opening is approximately one half the diameter of said riser body cavity.

10. A mold assembly, comprising:

a mold comprising a body portion having a mold cavity and a riser cavity therein; and, a riser held in said mold body portion riser cavity, said riser comprising:

a riser body formed of an exothermic material which is capable of igniting when contacted by molten metal, a cavity located in said riser body, a first opening in said riser body for communicating said riser body cavity with said mold cavity, and wherein said riser body exothermic material consists essentially of a reactive mixture which includes, in weight percent, from about 25% to 65% silica, from about 5% to 18% sodium nitrate, from about 1% to 8% sodium hexafluoroilicate, from about 15% to 40% aluminum, and from 2% to 20% iron oxide.

11. The assembly of claim 10 wherein said riser body cavity has a diameter that is substantially twice as large as a diameter of said riser body first opening.

12. The assembly of claim 10 wherein said riser body first opening is located in a bottom section of said riser body and further comprising a second opening located in a top section of said riser body.

13. The assembly of claim 10 further comprising a blinder substance, consisting essentially of sodium silicate, for holding said exothermic material of said riser body in a preformed shape.

* * * * *

US004858673B1

REEXAMINATION CERTIFICATE (1874th)

United States Patent [19]

Campana et al.

[11] B1 4,858,673

[45] Certificate Issued Dec. 8, 1992

[54] RISER CONSTRUCTION

[75] Inventors: Patsie C. Campana; David L. Compana, both of Lorain, Ohio

[73] Assignee: Caldo International Inc., Lorain, Ohio

Reexamination Request:
No. 90/002,273, Feb. 7, 1991

Reexamination Certificate for:

| | |
|---|---|
| Patent No.: | 4,858,673 |
| Issued: | Aug. 22, 1989 |
| Appl. No.: | 232,936 |
| Filed: | Aug. 16, 1988 |

Related U.S. Application Data

[63] Continuation-in-part of Ser. No. 112,383, Oct. 22, 1987.

[51] Int. Cl.[5] ..... B22C 9/08
[52] U.S. Cl. ..... 164/359; 164/360
[58] Field of Search ..... 164/53, 359, 360

[56] References Cited

U.S. PATENT DOCUMENTS 3,815,665 6/1974 Baur ..... 164/359

FOREIGN PATENT DOCUMENTS

| | | |
|---|---|---|
| 45-23229 | 8/1970 | Japan . |
| 627678 | 8/1949 | United Kingdom . |
| 774491 | 5/1957 | United Kingdom . |
| 793022 | 4/1958 | United Kingdom . |
| 894676 | 4/1962 | United Kingdom . |
| 911801 | 11/1962 | United Kingdom . |
| 1083493 | 9/1967 | United Kingdom . |

*Primary Examiner*—K. Y. Lin

[57] ABSTRACT

A riser for a mold includes a riser body formed of an exothermic material. A cavity is located in the riser body and is adapted to contain an associated molten metal. An opening is provided in the riser body for communicating the riser body cavity with a cavity of an associated mold. The riser body exothermic material consists essentially of a reactive mixture which includes, in weight percent, from about 25% to 65% silica, from about 5% to 18% sodium nitrate, from about 1% to 8% sodium hexafluorosilicate, from about 15% to 40% aluminum, and from about 2% to 20% iron oxide.

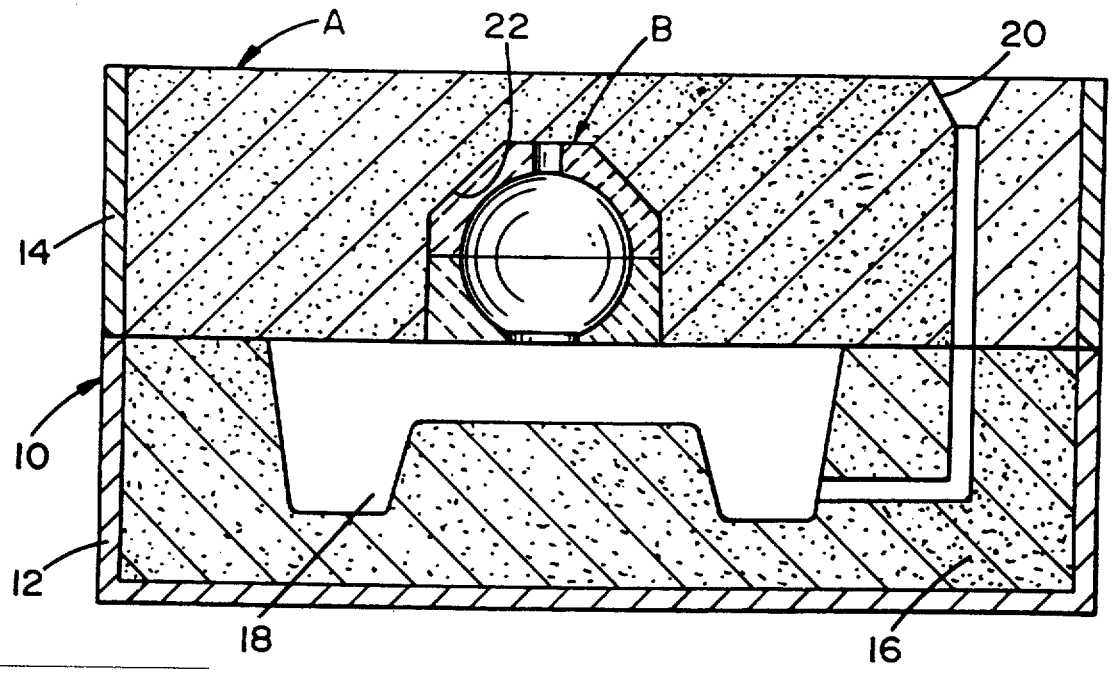

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-13 are cancelled.

* * * * *